US005094592A

United States Patent [19]

Nakajima et al.

[11] Patent Number: 5,094,592

[45] Date of Patent: Mar. 10, 1992

[54] VARIABLE CAPACITY VANE COMPRESSOR HAVING A SEAL PROTECTIVE STRUCTURE

[75] Inventors: Nobuyuki Nakajima; Toshio Yamaguchi, both of Konan, Japan

[73] Assignee: Zexel Corporation, Tokyo, Japan

[21] Appl. No.: 571,929

[22] Filed: Aug. 24, 1990

[30] Foreign Application Priority Data

Jan. 11, 1990 [JP] Japan ..... 2-6017

[51] Int. Cl.[5] ..... F04B 49/00

[52] U.S. Cl. ..... 417/295; 417/310; 418/96

[58] Field of Search ..... 417/295, 310; 418/96

[56] References Cited

U.S. PATENT DOCUMENTS

| | | | |
|---|---|---|---|
| 2,883,101 | 4/1959 | Kosfeld | 418/96 |
| 4,776,770 | 10/1988 | Nakajima et al. | 417/295 |
| 4,778,352 | 10/1988 | Nakajima | 417/310 |
| 4,842,490 | 6/1989 | Watanabe et al. | 417/295 |
| 4,869,652 | 9/1989 | Nakajima et al. | 417/310 |
| 4,875,835 | 10/1989 | Nakajima et al. | 417/295 |
| 4,929,156 | 5/1990 | Eitai et al. | 417/295 |
| 4,948,345 | 8/1990 | Nakajima | 417/295 |

FOREIGN PATENT DOCUMENTS 0314819 5/1989 Fed. Rep. of Germany ..... 418/96

*Primary Examiner*—Richard A. Bertsch
*Assistant Examiner*—Michael I. Kocharov
*Attorney, Agent, or Firm*—Charles S. McGuire

[57] ABSTRACT

A variable capacity vane compressor has a first oil sump formed in a bottom of a discharge pressure chamber arranged at one side of a cylinder close to one side block, and a second oil sump formed in a bottom of a suction chamber arranged at another side of the cylinder close to the other side block. An oil passageway communicates between the first oil sump and the second oil sump. A control element is arranged in the other side block for rotation about its own axis in opposite directions to thereby vary the compression starting timing. A pressure chamber acts to apply control pressure created from discharge pressure from the cylinder to the control element for causing rotation of the control element. A seal member is fitted on the control element such that part of the seal member is located in the pressure chamber. A high pressure-introducing passageway is formed in the other side block and communicates with the second oil sump. The discharge pressure from the cylinder is introduced into the pressure chamber through the discharge pressure chamber, the first oil sump, the second oil sump, and the high pressure-introducing passageway.

3 Claims, 5 Drawing Sheets

VARIABLE CAPACITY VANE COMPRESSOR HAVING A SEAL PROTECTIVE STRUCTURE

BACKGROUND OF THE INVENTION

This invention relates to a variable capacity vane compressor which is intended to improve the protection of a seal member, etc. employed therein.

Conventionally, variable capacity vane compressor has been proposed e.g. by Japanese Provisional Patent Publication (Kokai) No. 64-36997, which is adapted to compress a refrigerant gas circulating in an air conditioning system for automotive vehicles.

The proposed compressor comprises a cylinder having a pair of side blocks closing opposite ends thereof, a rotor rotatably received within the cylinder, a discharge pressure chamber arranged at one side of the cylinder close to one of the side blocks, a first oil sump formed in a bottom of the discharge pressure chamber, a suction chamber arranged at the other side of the cylinder close to the other side block, a second oil sump formed in a bottom of the suction chamber, an oil passageway communicating between the first and second oil sumps, a control element arranged in the other side block for rotation about its own axis in opposite directions to thereby vary the compression starting timing, and a seal member fitted on the control element.

As shown in FIG. 1, the control element 150 has one end face thereof formed integrally with a pair of pressure-receiving protuberances 150*a* projected therefrom (only one of which is shown). The other side block 160 has an end face facing the rotor 170 in which an annular recess 160*a* is formed. The control element 150 is rotatably fitted in the annular recess 160*a* such that the pressure receiving protuberances 150*a* are slidably received in respective pressure working chambers defined in a bottom of the annular recess 160*a* to divide each pressure working chamber into a high pressure chamber $\mathbf{123}_2$ and a low pressure chamber, not shown.

With such an arrangement, the control element 150 rotates in response to the difference in pressure between the low pressure chamber and the high pressure chamber $\mathbf{123}_2$, to vary the compression starting timing and hence the capacity of the compressor. To ensure smooth rotation of the control element, the seal member 164 is fitted along an outer peripheral edge of each pressure receiving protuberance 150*a*, which is kept in gastight slidable contact with inner surfaces of the pressure working chamber, with a constant clearance provided between the pressure receiving protuberance and the pressure working chamber to heremetically seal the same chamber while allowing the pressure receiving protuberance 150*a* to slide on the chamber walls.

According to the proposed compressor, a short passageway, which is formed by a passage 200, a pressure chamber 201, and a passage 202, extends between a discharge valve chamber 142 and the high pressure chamber $\mathbf{123}_2$, to introduce compressed discharge gas from the discharge valve chamber 142 into the high pressure chamber $\mathbf{123}_2$, thereby creating a control pressure within the high pressure chamber $\mathbf{123}_2$, as shown in FIG. 1.

However, the temperature of the compressed discharge gas delivered into the high pressure chamber $\mathbf{123}_2$ is rather high, particularly when the compressor is in partial capacity operation. As a result, the seal member 164 is heated by the compressed discharge gas to become deteriorated, resulting in a shortened life of the seal member 164. In the worst case, the seal member 164 is broken upon rotation of the control element 150, whereby the gastightness by the seal member 164 is lost to make it impossible to carry out accurate capacity control. Besides, the broken seal member 164 can be caught in the annular recess 160*a* to impede rotation of the control element 150.

SUMMARY OF THE INVENTION

It is therefore an object of the invention to provide a variable capacity compressor which is capable of decreasing the temperature of the discharge gas introduced into a high pressure chamber thereof, to thereby prevent deterioration of the seal member and hence prolong the life thereof, as well as prevent the seal member from being broken or caught.

It is a further object of the invention to improve lubrication of the seal member to thereby improve the wear resistance, gastightness, and slidability thereof.

To attain the above objects, the present invention provides a variable capacity vane compressor including a cylinder having a pair of side blocks closing opposite ends thereof, a rotor rotatably received within the cylinder, a discharge pressure chamber arranged at one side of the cylinder close to one of the side blocks, the discharge pressure chamber having a bottom, a first oil sump formed in the bottom of the discharge pressure chamber, a suction chamber arranged at another side of the cylinder close to the other of the side blocks, the suction chamber having a bottom, a second oil sump formed in the bottom of the suction chamber, an oil passageway communicating between the first oil sump and the second oil sump, a control element arranged in the other side block for rotation about an axis thereof in opposite directions to thereby vary the compression starting timing, seal means fitted on the control element, a pressure chamber for applying control pressure created from discharge pressure from the cylinder to the control element for causing rotation thereof, part of the seal means being located in the pressure chamber.

The variable capacity vane compressor according to the prevent invention is characterized by an improvement comprising a high pressure-introducing passageway formed in the other side block and communicating with the second oil sump, and wherein the discharge pressure from the cylinder is introduced into the pressure chamber through the discharge pressure chamber, the first oil sump, the second oil sump, and the high pressure-introducing passageway.

Preferably, the other side block has an annular recess formed in one end face thereof facing the rotor, the control element being rotatably received in the annular recess, the control element having at least one pressure-receiving protuberance projected integrally from another end face thereof remote from the rotor, the pressure chamber being defined by at least one second recess formed in part of the annular recess, the pressure-receiving protuberance being slidably fitted in the second recess to divide the pressure chamber into a low pressure chamber communicating with the suction chamber, and a high pressure chamber communicating with the high pressure-introducing passageway.

More preferably, the compressor may include passage means communicating between the high pressure-introducing passageway and the suction chamber, and control valve means having a valve body arranged in the high pressure-introducing passageway and responsive to pressure within the suction chamber for opening and closing the passage means.

The above and other objects, features and advantages of the invention will be more apparent from the ensuring detailed description taken in conjunction with the accompanying drawings.

DETAILED DESCRIPTION

The invention will now be described in detail with reference to the drawings showing an embodiment thereof.

Referring to FIGS. 2 through 5, there is illustrated a variable capacity vane compressor according to an embodiment of the invention.

Figure 1:
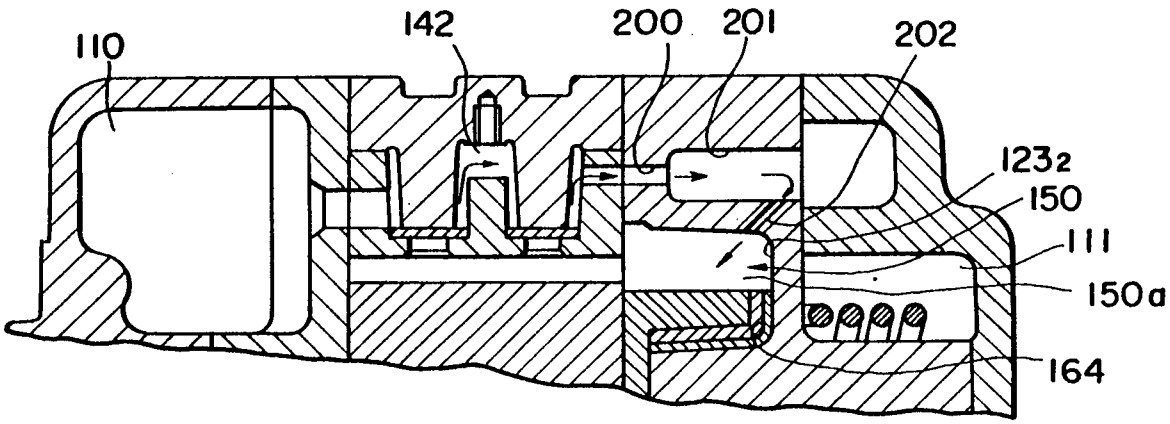
FIG. 1 is a fragmentary sectional view of a seal member and its peripheral parts of a conventional variable capacity vane compressor.
Figure 2:
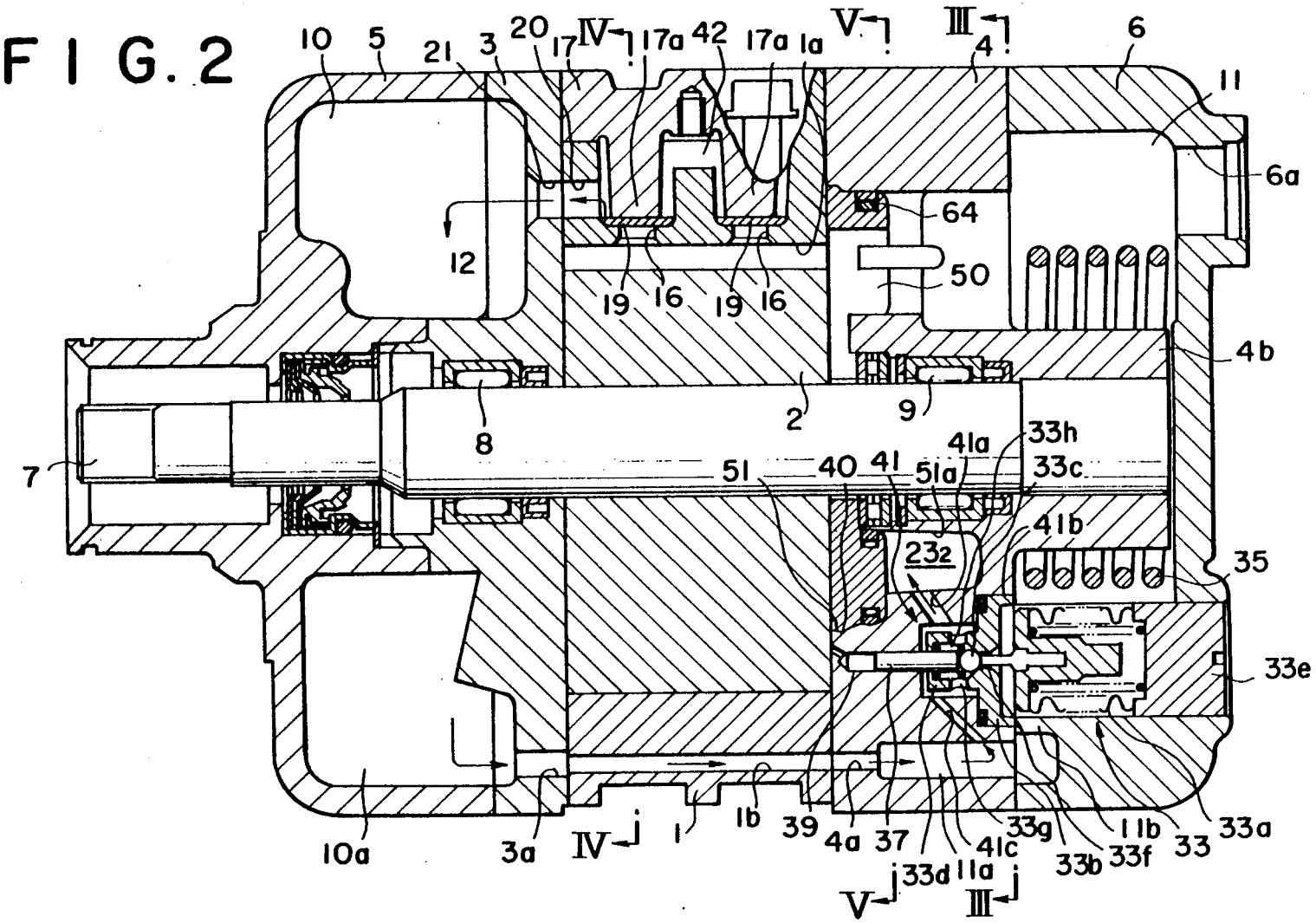
FIG. 2 is a longitudinal sectional view of a variable capacity vane compressor according to an embodiment of the invention.

As shown in FIG. 2, the variable capacity vane compressor is composed mainly of a cylinder formed by a cam ring 1 having an inner peripheral surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a rotary shaft 7 rotatably supported by bearings 8 and 9 provided, respectively, in the front side block 3 and the rear side block 4.

A discharge port, not shown, is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port and the suction port 6*a* communicate, respectively, with a discharge pressure chamber 10 defined by the front head 5 and the front side block 3, and a suction chamber 11 defined by the rear head 6 and the rear side block 4.

Figure 4:
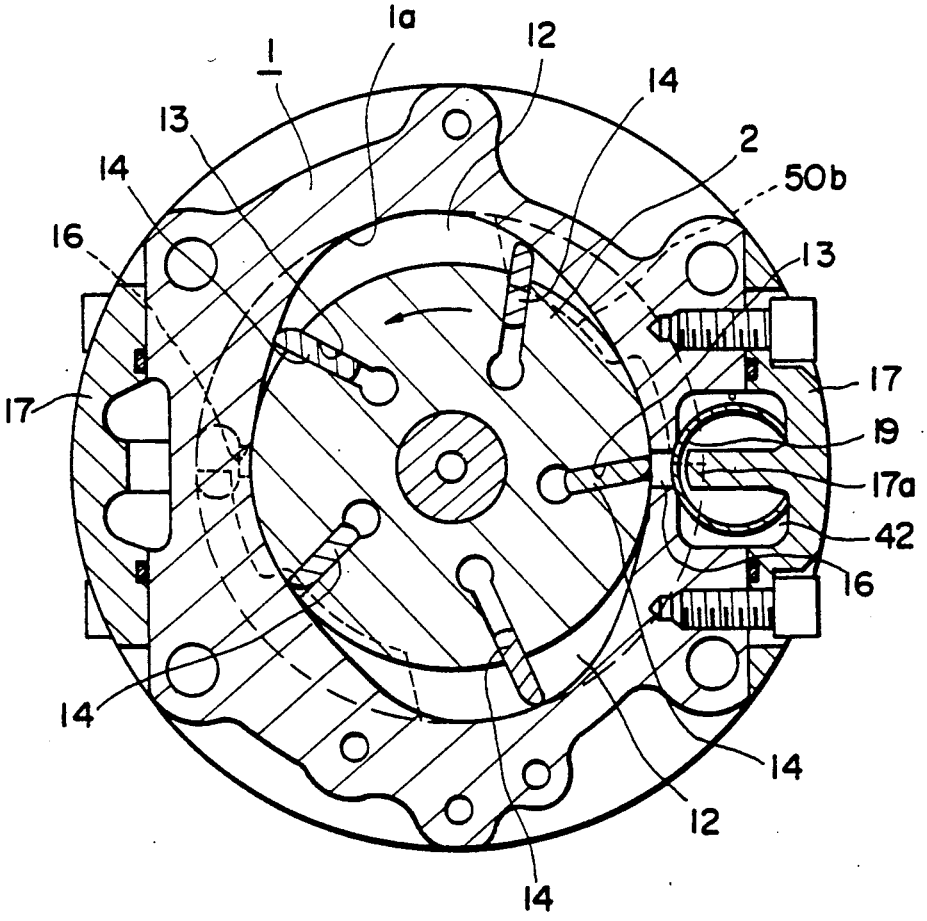
FIG. 4 is a transverse sectional view taken along line IV—IV in FIG. 2.

A pair of compression spaces 12, 12 are defined at diametrically opposite locations between the inner surfaces of the cylinder, the outer peripheral surface of the rotor 2, as shown in FIG. 4. The rotor 2 has its outer peripheral surface formed therein with a plurality of axial vane slits 13 at circumferentially equal intervals, in each of which a vane 14 is radially slidably fitted.

Figure 3:
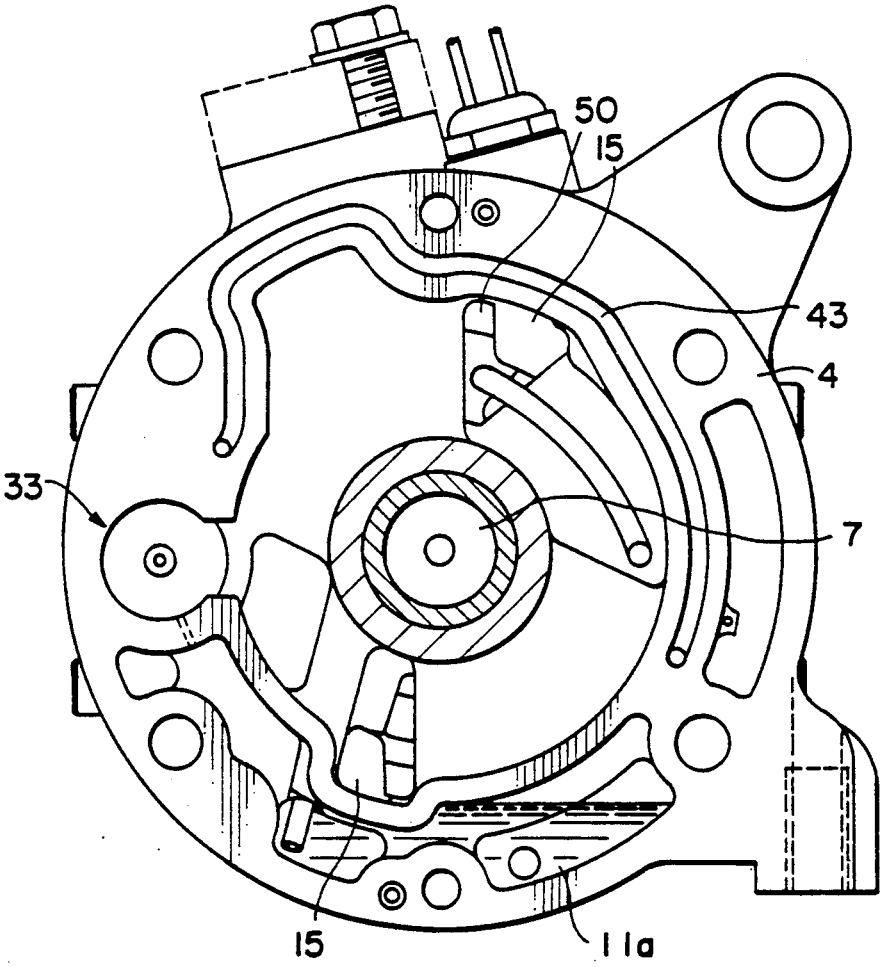
FIG. 3 is a transverse sectional view taken along line III—III in FIG. 2.

Refrigerant inlet ports 15, 15 are formed in the rear side block 4 at diametrically opposite locations, as shown in FIG. 3. These refrigerant inlet ports 15, 15 axially extend through the rear side block 4, and through which the suction chamber 11 and the compression spaces 12, 12 are communicated with each other.

Two sets of refrigerant outlet ports 16, 16, each having two openings, are formed through opposite lateral side walls of the cam ring 1 at diametrically opposite locations, though only one of them is shown in FIG. 2. The opposite lateral side walls of the cam ring 1 are provided with two discharge valve covers 17, 17, each formed integrally with a valve stopper 17*a*, and fixed to the cam ring 1 by fixing bolts, not shown. Discharge valves 19, 19 are mounted between the respective lateral side walls of the cam ring 1 and the valve covers 17, 17 in a manner being supported by the valve covers 17, 17, such that when acted upon by discharge pressure, the discharge valve 19 is deformed to open to refrigerant discharge port 16. Discharge valve chambers 42, 42 are defined between the cam ring 1 and the discharge valve covers 17. At each discharge valve 19, a communication passage 20 is formed in the cam ring 1 which is aligned with a communication passage 21 formed in the front side block 3 so that a compressed refrigerant gas from the compression space 12 is delivered through the refrigerant outlet port 16, the discharge valve chamber 42, the communication passages 20, 21, the discharge pressure chamber 10, and the discharge port, in the mentioned order, when the discharge valve 19 is opened to open the refrigerant outlet port 16.

As shown in FIG. 2, a front oil sump 10*a* is formed in a bottom portion of the discharge pressure chamber 10, whereas a rear oil sump 11*a* is formed with a first bottom space $\mathbf{11}_{a1}$ in the rear side block 4 and a second bottom space $\mathbf{11}_{a2}$ in communication with the first bottom space $\mathbf{11}_{a1}$ and below the suction chamber 11 in a manner being isolated from the suction chamber 11 by a partition wall 11*b* of the rear head 6. The front oil sump 10*a* and the rear oil sump 11*a* are in communication with each other via an oil passageway formed by an oil hole 3*a* extending in the front side block 3, an oil hole 1*b* through the cam ring 1, and an oil hole 4*a* through the rear side block 4.

Figure 5:
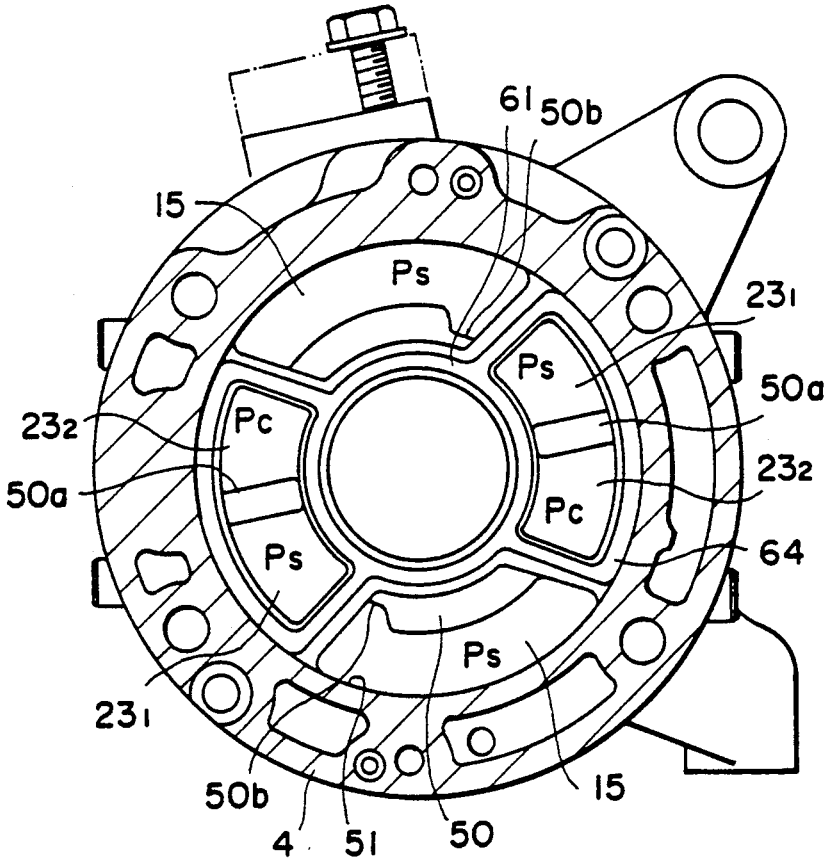
FIG. 5 is a sectional view taken along line V—V in FIG. 2.

As shown in FIGS. 2 and 5, the rear side block 4 has an end face opposed to the rotor 2, in which is formed an annular recess 51 which is continuous with the refrigerant inlet ports 15, 15. A control element 50, which is in the form of an annulus, is received in the annular recess 51 for rotation about its own axis in opposite circumferential directions. The control element 50 has one side surface thereof remote from the rotor 2 formed integrally with a pair of pressure-receiving protuberances 50*a*, 50*a* axially projected therefrom at diametrically opposite locations and acting as pressure-receiving elements. Each pressure-receiving protuberance 50*a* is slidably received in a pressure working chamber 51*a* formed in a bottom of the annular recess 51 so that the interior of the pressure working chamber 51*a* is divided into a low pressure chamber $\mathbf{23}_1$ and a high pressure chamber $\mathbf{23}_2$, by the pressure-receiving protuberance 50*a*. A seal member 64, which is formed, e.g. of rubber, is fitted on the control element 50 to seal between the low pressure chamber $\mathbf{23}_1$ and the high pressure chamber $\mathbf{23}_2$ in a gastight manner.

As shown in FIG. 3, the control element 50 has its outer peripheral edge formed with a pair of cutouts 50*b*, 50*b* at diametrically opposite locations. These cutouts 50*b*, 50*b* serve to determine the timing of closure of the refrigerant inlet ports 15, 15 and hence the compression starting timing. That is, as the control element 50 is rotated, the circumferential positions of the cutouts 50*b*, 50*b* are varied to thereby vary the compression starting timing of the compressor. The low pressure chambers $\mathbf{23}_1$, $\mathbf{23}_1$ each communicate with the suction chamber 11 through the respective inlet port 15, 15, to be supplied with suction pressure Ps from the suction chamber 11.

On the other hand, one of the high pressure chambers $\mathbf{23}_1$, $\mathbf{23}_1$ is communicatable with one of the discharge valve chambers 42 via a high pressure-introducing passageway 41 formed in the rear side block 4, the rear oil sump 11*a*, the oil passageway, i.e. the oil holes 4*a*, 1*b*, and 3*a*, the front oil sump 10*a*, the discharge pressure chamber 10, and the communication holes 20, 21. The other high pressure chamber $23_2$ is in communication with one high pressure chamber $23_2$ via a communication passage 43 (shown in FIG. 3) formed in the rear side block 4. With such an arrangement, compressed refrigerant gas having high temperature and high pressure is delivered from the compression space 12 through the opened refrigerant outlet port 16, the discharge valve chamber 42, the communication holes 20, 21, the discharge pressure chamber 10, the front oil sump 10*a*, the oil holes 3*a*, 1*b*, and 4*a*, the rear oil sump 11*a*, and the high pressure-introducing passageway 41, in the mentioned order, into the one high pressure chamber $23_2$. Futher, part of the refrigerant gas delivered into the one high pressure chamber $23_2$ is further delivered to the other high pressure chamber $23_2$ through the communication passage 43, thereby creating control pressure Ps within both high pressure chambers $23_2$, $23_2$. Further, the one high pressure chamber $23_2$ is also communicatable with the suction chamber 11 through a control valve device 33 arranged in the high pressure-introducing passageway 41. The passageway 41 is formed by a through hole 41*a*, a valve bore 41*b*, and a through hole 41*c*, all formed in the rear side block 4. The valve bore 41*b* directly opens into the suction chamber 11, thus forming passage means communicating between the high pressure-introducing passageway 41 and the suction chamber 11.

The control valve device 33 operates in response to change in the suction pressure Ps within the suction chamber 11. That is, when the control valve device 33 is opened, it allows the control pressure Ps within the high pressure chambers $23_2$, $23_2$ to leak therethrough into the suction chamber 11. The control valve device 33 is mainly composed of a flexible bellows 33*a* as a pressure responsive member, a valve casing 33*b*, a ball valve body 33*c*, and a spring 33*d* urging the ball valve body 33*c* in a direction of closing the valve. The bellows 33*a* is disposed within the suction chamber 11, for expansion and contraction in response to change in the suction pressure. The valve casing 33*b* is fitted in the valve hole 41*b*.

When the suction pressure Ps is above a predetermined valve (e.g. 2 $Kg/cm^2$) set by an adjusting member 33*e*, the bellows 33*a* contracts to permit the ball valve body 33*c* urged by the spring 33*d* to close a central hole 33*f* formed through the valve casing 33*b*, thereby disconnecting the valve bore 41*b* from the suction chamber 11. As a result, the control pressure Pc within the high pressure chambers $23_2$, $23_2$ is inhibited from leaking into the suction chamber 11, so that the control pressure Pc increases to cause the control element 50 to rotate in a direction of advancing the compression starting timing or increasing the capacity of the compressor.

On the other hand, when the suction pressure Ps is below the predetermined value, the bellows 33*a* expands to urge the ball valve body 33*c* to open the central hole 33*f*, thereby bringing the one high pressure chamber $23_2$ into communication with the suction chamber 11 through the through hole 41*a*, valve hole 41*b*, radial holes 33*g* formed in the valve casing 33*b*, a valve case chamber 33*h* defined within the valve casing 33*b*, and the central hole 33*f* of the valve casing 33*b*. As a result, the control pressure Pc within the high pressure chambers $23_2$, $23_2$ is allowed to leak through the control valve device 33 into the suction chamber 11, so that the control pressure Pc decreases to cause the control element 50 to rotate in a direction of retarding the compression starting timing or decreasing the capacity of the compressor.

A plunger hole 39 is axially formed in the rear side block 4, in which a plunger 37 is slidably received. The plunger 37 is movable in response to discharge pressure Pd introduced into the plunger hole 39 through a high pressure-introducing hole 40, to urge the ball valve body 33*c* in the valve closing direction.

As shown in FIG. 2, a torsion coiled spring 35 is disposed around a hub 4*b* extending integrally from the rear side block 4, with one end thereof engaged in one end face of the control element 50, and the other end thereof engaged in the hub 4*b* of the rear side block, and urges the control element 50 in the direction of decreasing the capacity of the compressor.

The operation of the compressor constructed as above will now be explained.

The hot compressed refrigerant gas from the compression chamber 12 is introduced into the discharge pressure chamber 10 through the discharge valve chamber 42, and the communication holes 20, 21, and part of the compressed refrigerant gas is delivered through the discharge port, whereas the remainder of the compressed refrigerant gas dissolves into the oil stored in the front oil sump 10*a*. This dissolved refrigerant gas is introduced into the rear oil sump 11*a* with the oil through the oil holes 3*a*, 1*b* and 4*a*, and evaporates from the oil in the rear oil sump 11*a*, as the pressure in the rear oil sump 11*a* is lower than the pressure in the front oil sump 10*a*. This evaporated refrigerant gas is introduced into the high pressure chamber $23_2$ through the high pressure passageway 41 (see FIGS. 2 and 3). During this long travel, the heat of the refrigerant gas is dissipated so that the temperature of the refrigerant gas delivered into the high pressure chambers $23_2$, $23_2$ lowers by a great amount. Especially, the heat of the hot compressed refrigerant gas is positively dissipated by the oil, while the refrigerant gas travels from the front oil sump 10*a* to the rear oil sump 11*a*. And, as the second bottom space $11_{a2}$ is faced with the suction chamber 11 through the partition 11*b* and the temperature in the suction chamber 11 is lower than the outside temperature, the evaporated refrigerant gas in the rear oil sump 11*a* is cooled by the partition 11*b*.

The following table shows differences in the temperature of the refrigerant gas between the discharge valve chamber 42 and the high pressure chambers $23_2$ under the condition that the discharge pressure Pd is 14 $kg/cm^2$, and the rotational speed of the compressor is 5,000 rpm:

| | Td-Tc (°C.) | |
|---|---|---|
| | FULL CAPACITY OPERATION | PARTIAL CAPACITY OPERATION |
| CONVENTIONAL COMPRESSOR | 17–39 | 0–5 |
| COMPRESSOR ACCORDING TO THE INVENTION | 25–37 | 14–26 |

In the table, Td is the temperature of the refrigerant gas within the discharge valve chamber 42, and Tc is the temperature of the refrigerant gas within the high pressure chambers $23_2$, $23_2$.

As will be understood from the above table, the larger the value Td–Tc, the lower the temperature of the refrigerant gas delivered into the high pressure chambers $23_2$, $23_2$.

When the seal member 64 is used at a temperature within a range of 130° to 150° C., it will have durability degraded to a remarkable extent, particularly if it is formed of rubber. Therefore, it is advantageous in improving the durability of the seal member 64, to decrease the temperature of refrigerant gas by about 10° to 20° C. particularly during the partial capacity operation, as is realized by the structure according to the present invention.

Therefore, there is almost no possibility that the seal member 64 is broken due to the heat of the refrigerant gas within the high pressure chamber $23_2$, $23_2$ upon rotation of the control element 50, to decrease its degree of airtightness 64 or to be caught in the annular recess 51.

Further, since the refrigerant gas discharged from the refrigerant outlet port 16 flows through the front and rear oil sumps 10*a*, 11*a*, the refrigerant gas delivered into the high pressure chambers $23_2$, $23_2$ is enriched with lubricating oil, and hence serves to improve lubrication of the seal member 64, thereby improving the wear resistance, airtightness, and slidability of the same member.

Further, particularly during the partial capacity operation of the compressor, there occurs a greater amount of refrigerant gas flow from the front head 5 side to the rear side block 4 side through the above passageway so that parts on the rear side block 4 side are adequately lubricated by oil contained in the gas flow.

What is claimed is:

1. In a variable capacity vane compressor including a cylinder having a pair of side blocks closing opposite ends thereof, a pair of heads secured to said side blocks a rotor rotatably received within said cylinder, a discharge pressure chamber defined by one of said side blocks and one of said heads, said discharge pressure chamber having a bottom, a first oil sump formed in said bottom of said discharge pressure chamber, a suction chamber defined by the other of said side blocks and the other of said heads, a second oil sump formed in said a second oil sump formed in said bottom of the other side block, an oil passageway communicating between said first oil sump and said second oil sump, a control element received in an annular recess formed in an end face of said other side block opposed to said rotor for rotation about an axis thereof in opposite directions to thereby vary the compression starting timing, said control element having one side surface thereof remote from said rotor formed therein with at least one pressure-receiving protuberance, seal means fitted on said control element, a high pressure chamber for applying control pressure created from discharge pressure from said cylinder to said control element for causing rotation thereof, and a low pressure chamber being in communication with said suction chamber, said high and low pressure chambers being separated from each other by said protuberance, the improvement comprising a high pressure-introducing passageway formed in said other side block and communicating said high pressure chamber with said second oil sump, and wherein said discharge pressure from said cylinder is introduced into said high pressure chamber through said discharge pressure chamber, said first oil sump, said second oil sump, and said high pressure-introducing passageway.

2. A variable capacity vane compressor as claimed in claim 1, including passage means communicating between said high pressure-introducing passageway and said suction chamber, and control valve means having a valve body arranged in said high pressure-introducing passageway and responsive to pressure within said suction chamber for opening and closing said passage means.

3. A variable capacity vane compressor as claimed in claim 1 or 2, wherein said second oil sump is formed with a first bottom space in said other side block and a second bottom spaced being in communication with said first bottom space and formed below said suction chamber in a manner being isolated from said suction chamber by a partition wall of said another head.

* * * * *